US006422446B1

(12) United States Patent
Liu

(10) Patent No.: US 6,422,446 B1
(45) Date of Patent: Jul. 23, 2002

(54) ADJUSTING APPARATUS OF A TRIGGER OF A PNEUMATIC NAILER

(75) Inventor: Park Liu, 4972 Heritage Dr., Chino Hills, CA (US) 91709

(73) Assignee: Park Liu, Chino Hills, CA (US)

( * ) Notice: Subject to any disclaimer, the term of this patent is extended or adjusted under 35 U.S.C. 154(b) by 68 days.

(21) Appl. No.: 09/749,320

(22) Filed: Dec. 28, 2000

(51) Int. Cl.[7] ..... B25C 1/04
(52) U.S. Cl. ..... 227/8; 227/130
(58) Field of Search ..... 227/8, 130, 156; 173/170

(56) References Cited

U.S. PATENT DOCUMENTS 5,551,621 A * 9/1996 Vallee ..... 227/130
5,692,663 A * 12/1997 Yang ..... 227/8
5,797,533 A * 8/1998 Lee ..... 227/8
5,836,501 A * 11/1998 Lai ..... 227/8
6,059,161 A * 5/2000 Chang et al. ..... 227/130
6,116,488 A * 9/2000 Lee ..... 227/8
6,213,372 B1 * 4/2001 Chen ..... 227/8

* cited by examiner

*Primary Examiner*—Scott A. Smith
(74) *Attorney, Agent, or Firm*—Supco

(57) ABSTRACT

The present invention relates to an adjusting apparatus of a trigger of a pneumatic nailer comprising a gun body whose trigger assembly includes a primary trigger and a secondary trigger. A safety inflection arm presses against the secondary trigger. At least two coupled shaft holes are formed on the respective side plates of the primary trigger while a neck is interposed between the two shaft holes. An adjusting assembly composed by a shaft, a compression spring and a press block is pivotably connected to the secondary trigger so that the adjusting assembly is movable between the two shaft holes and the relative position between the secondary trigger and the safety inflection arm is rapidly adjustable.

2 Claims, 7 Drawing Sheets

ADJUSTING APPARATUS OF A TRIGGER OF A PNEUMATIC NAILER

BACKGROUND OF THE INVENTION

1. Field of the Invention

The present invention relates to a pneumatic nailer, and more particularly, to a device with a function of the rapid switching between single and sequential discharge of fasteners.

2. Description of the Prior Art

The conventional pneumatic nailer makes use of the compression air for driving fasteners into woody or plastic objects for fixing. The discharge force is extremely strong and is dangerous to a certain extent. Therefore, the conventional nailer is fitted with a safety apparatus, as shown in FIG. 7. The so-called safety apparatus includes a safety inflection arm 11 provided at front end of a mouth of a gun body. When the front end of the safety inflection arm 11 is pressed in a coupled manner, a connecting rod 12 at rear end thereof is in pressing contact against a secondary trigger 14. When the primary trigger 13 is pulled back, the secondary trigger 14 is slightly moved inwards to press against a firing key 15 for completing the discharge action. Thereafter, if the user doesn't release the safety inflection arm 11, the secondary trigger 14 won't complete a second discharge due to an improper contact thereof with the connecting rod 12. Thus, an unexpected second discharge is avoided. However, it's impractical that another discharge can be performed only after release of the safety inflection arm 11. Accordingly, a bar 16 is pivotably arranged parallel to and below the safety inflection arm 11. This bar 16 is pivotable between a protruding and hidden state while the other end thereof is positioned by means that a steel ball 17 and a spring 18 press against it. When the bar 16 is situated at a protruding position, as shown in FIG. 8, and is shifted with the safety inflection arm 11 to contact with the secondary trigger 14, a sequential ordinary contact state of the safety inflection arm 11 with the secondary trigger 14 is ensured to create a sequential discharge. However, the pivotal position of the bar 16 inside the gun body is bad and the installation of the positioning elements is impractical so that following drawbacks in use and in assembly are caused:

1. In pivotable installation of the bar, the spring and the steel ball have to be placed in a receptacle. The receptacle is situated at the inner rim of a mounting seat on which the bar is pivotably mounted. Therefore, it's time-wasting and energy-consuming in assembling the spring and the steel ball. Besides, the steel ball is pressed by the spring and positioned at one end of the bar so that the steel ball is easily separated from the receptacle by being pressed by the spring before installation of the bar.
2. In use, as shown in FIGS. 7 and 8, the bar is pivotably arranged between the primary trigger and the safety inflection arm. The arrangement space is too small. Besides, it's not easy that the bar is moved when it's pivotably mounted at the mounting seat and restrained by the steel ball. It's not only to cause inconvenience in use, but also easily lead to knocking injuries of fingers in case of carelessness.

SUMMARY OF THE INVENTION

It is a primary object of the present invention to overcome the drawbacks associated with the prior art and to provide an adjusting apparatus of a trigger of a pneumatic nailer, wherein the adjustable apparatus is movable between two shaft holes of a primary trigger so as to rapidly adjust the relative position between a secondary trigger and a safety inflection arm. Accordingly, the single and sequential discharge of the gun body is more easily switchable.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
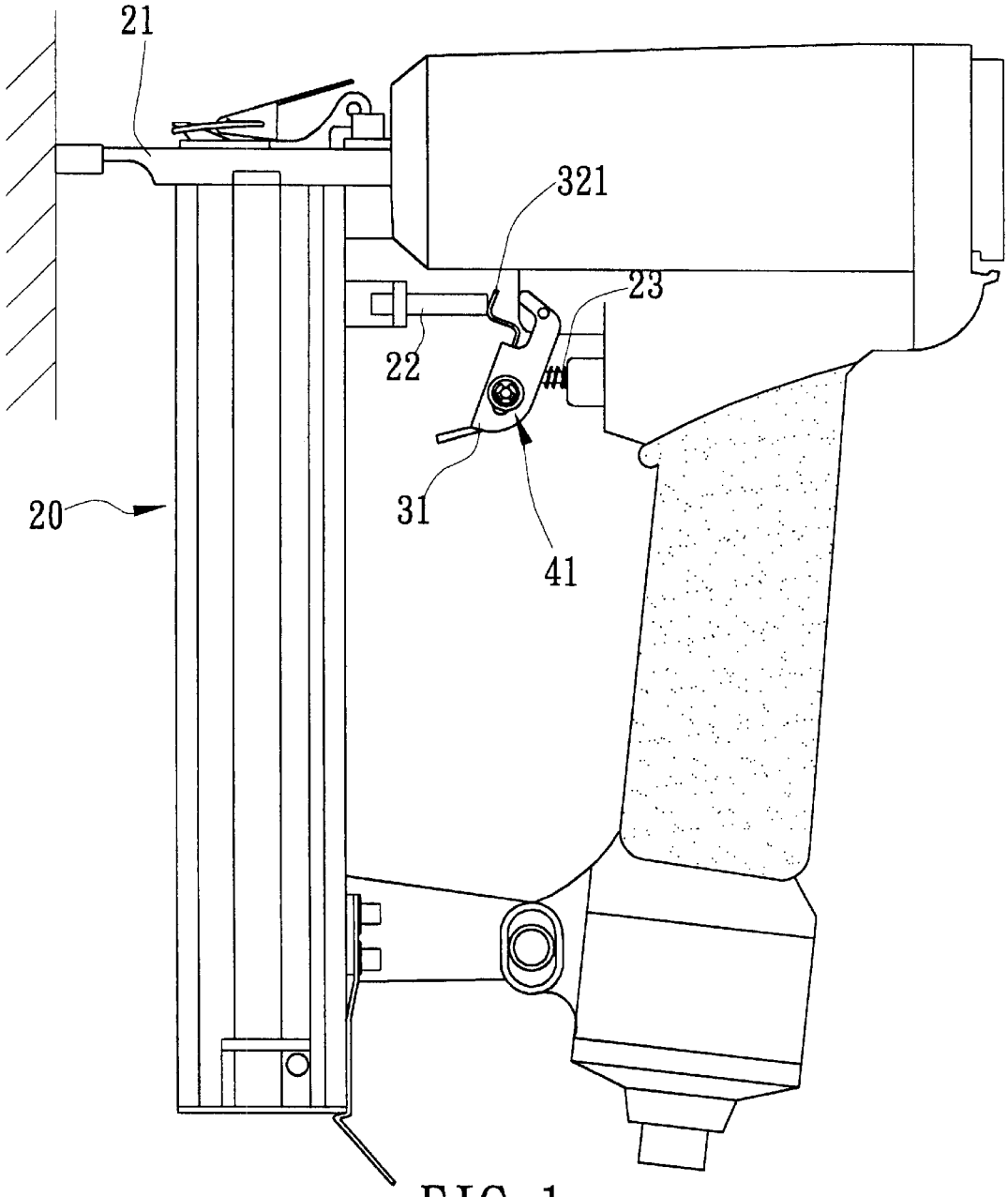
FIG. 1 is a side view of the present invention after assembly.
Figure 2:
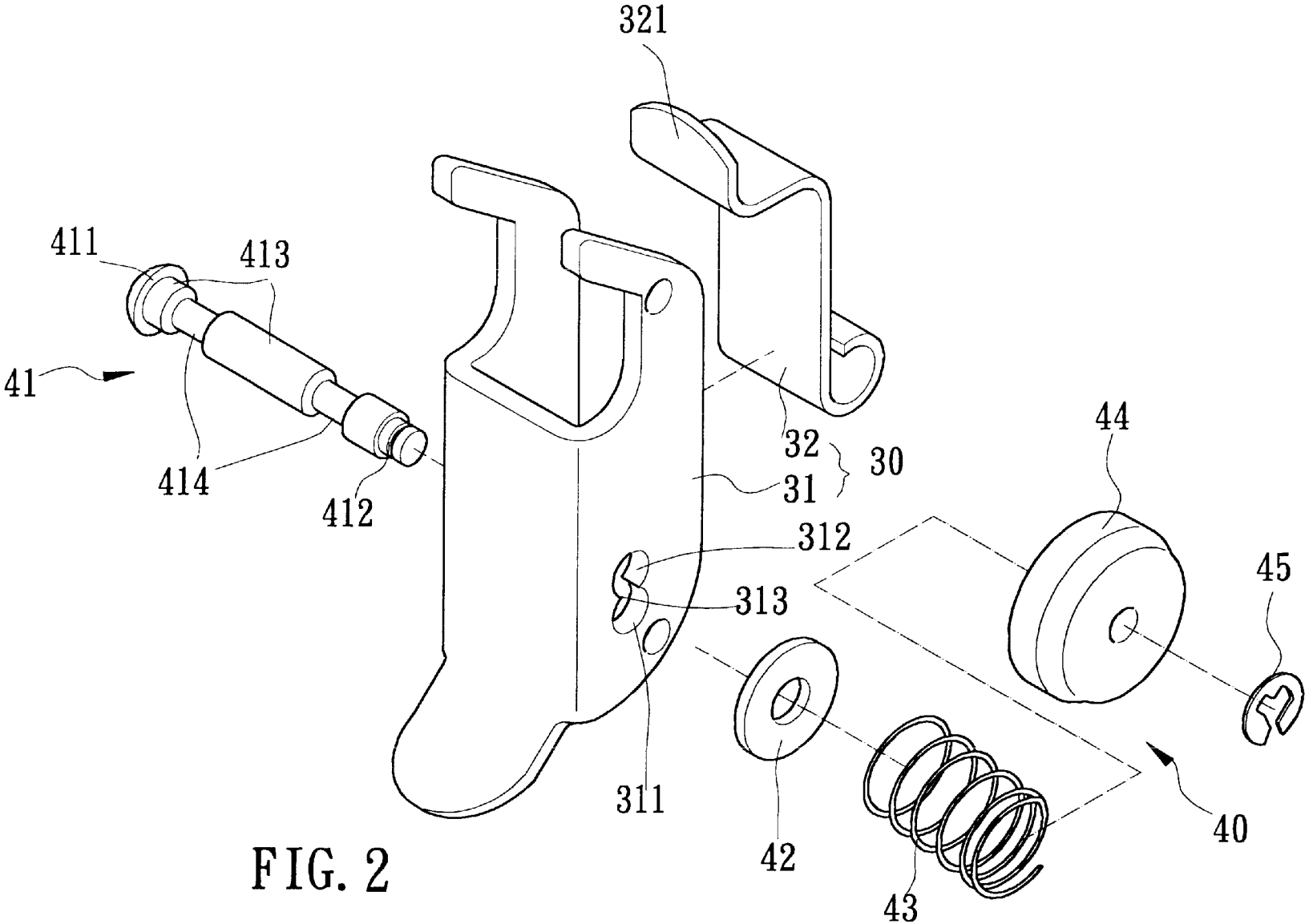
FIG. 2 is an exploded perspective view of the present invention.

Referring to FIGS. 1 and 2, the present invention includes a gun body 20 having a safety inflection arm 21 at front end thereof. A coupled rod 22 at rear end of the safety inflection arm 21 extends toward the front end of a trigger assembly 30 which comprises a primary trigger 31 and a secondary trigger 32. One end of the secondary trigger 32 is pivotably connected to the primary trigger 31 while a certain height is kept between a push piece 321 at rear end thereof and the coupled rod 22 such that the coupled rod 22 pushes against the push piece 321 in firing the gun body 20. Accordingly, a firing key 23 of the gun body 20 is pressed to create a firing action in pulling back the primary trigger 31. The above-mentioned structure belongs to the prior art so that it won't be described more hereinafter.

The present invention is characterized in that a first shaft hole 311 and a second shaft hole 312 are respectively formed at two side plates of the primary trigger 31 while the both holes are communicated with each other, and that a neck 313 is formed at the connection of two shaft holes 311, 312, and that an adjusting assembly 40 is placed between two shaft holes 311, 312 and pivotably connected to the secondary trigger 32.

The adjusting assembly 40 comprises a shaft 41 having a head 411 disposed at one end thereof and a ringed groove 412 at the other end thereof. Two blocking members 413 and two recessed members 414 are formed between said head 411 and said ringed groove 412. The two blocking members 413 are lockable into the two shaft holes 311, 312 of the primary trigger 31. The outer diameter of the two blocking members 413 is slightly larger than the width of the neck 313 while the outer diameter of the two recessed members 414 is slightly smaller than that of the two blocking members 413. And the two recessed members 414 are able to exactly pass through the necks 313.

Figure 4:
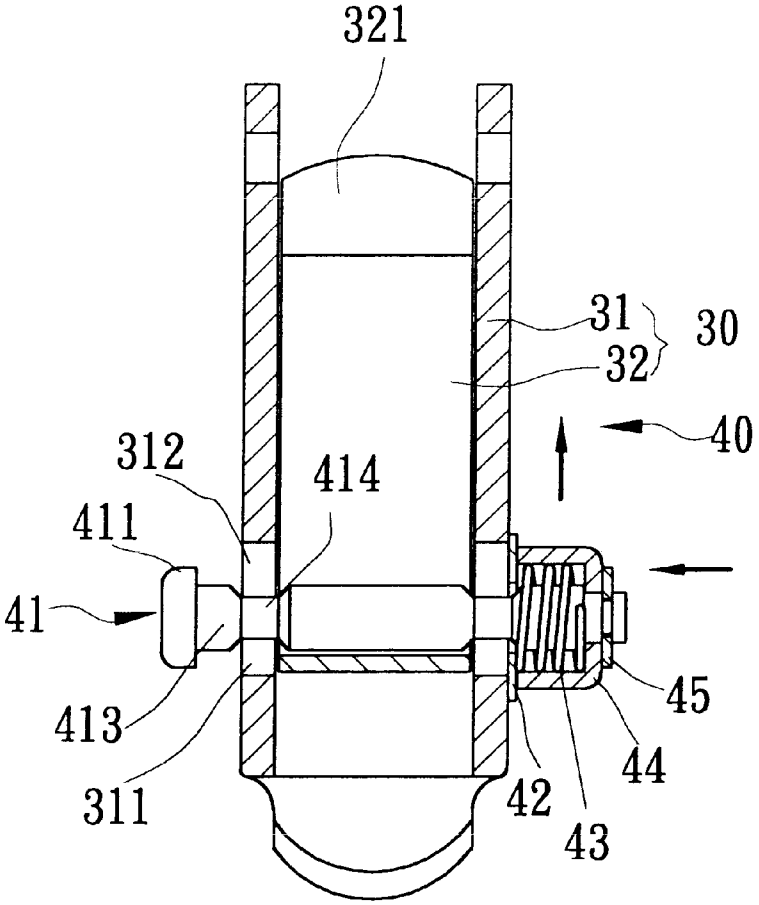
FIG. 4 is a sectional view of the present invention after actuation.
Figure 3:
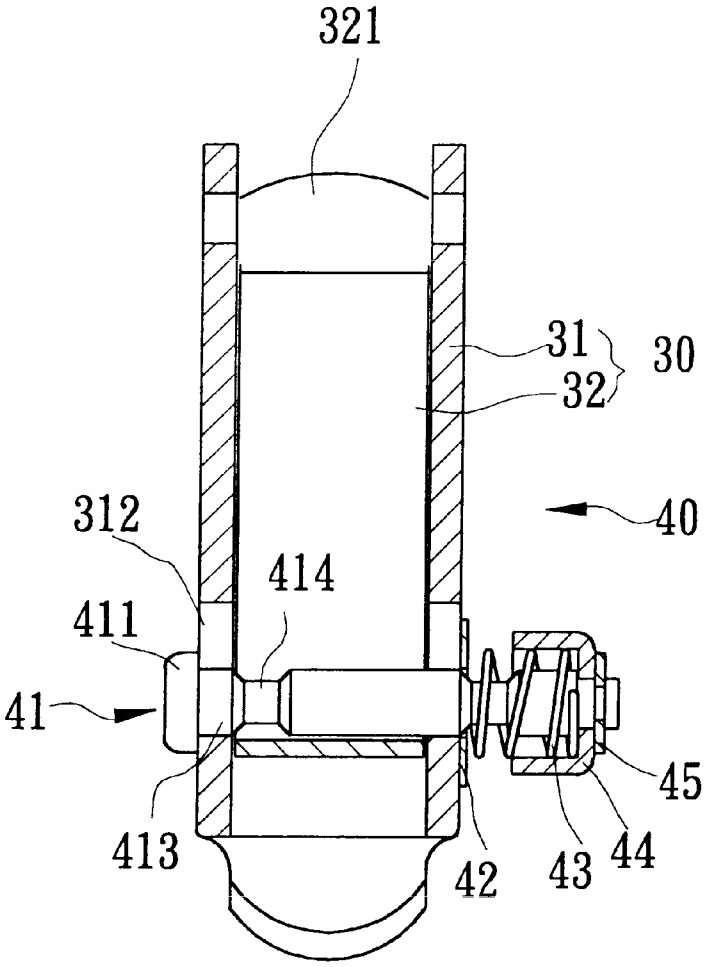
FIG. 3 is a sectional view of the present invention before actuation.

After the shaft 41 is inserted into the first shaft hole 311, a washer 42, a compression spring 43 and a press block 44 are successively inserted into the opposite end of the head 411 while a C-shaped fastener 45 is mounted on the ringed groove 412 for fixing the above-mentioned elements. In the ordinary state, the blocking members 413 of the shaft 41 are locked in the first shaft holes 311, as shown in FIG. 3. When the press block 44 is pushed by an external force, the shaft 41 will horizontally be shifted at a certain distance in order that the recessed members 414 of the shaft 41 pass through the necks 313 and enter into the second shaft hole 312, as shown in FIG. 4. Accordingly, a relative height between the secondary trigger 32 and the coupled rod 22 is duly adjustable.

In addition, the other end of the head 411 can be threaded (not shown) for a screwing fixation of the press block 44 thereon. This has the same effect to the C-shaped fastener 45.

Figure 5:
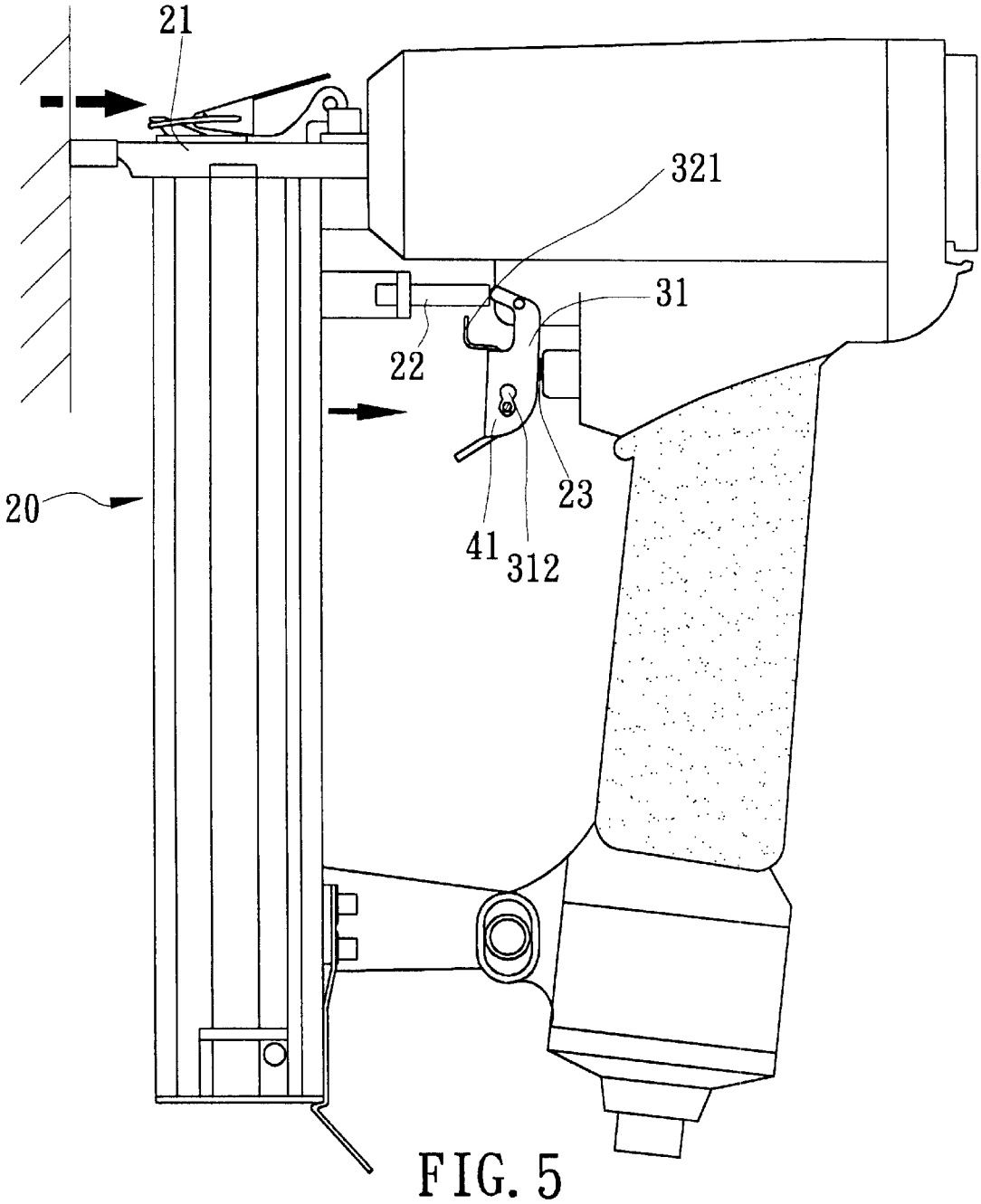
FIG. 5 is a side view of the present invention in a single discharge state.
Figure 6:
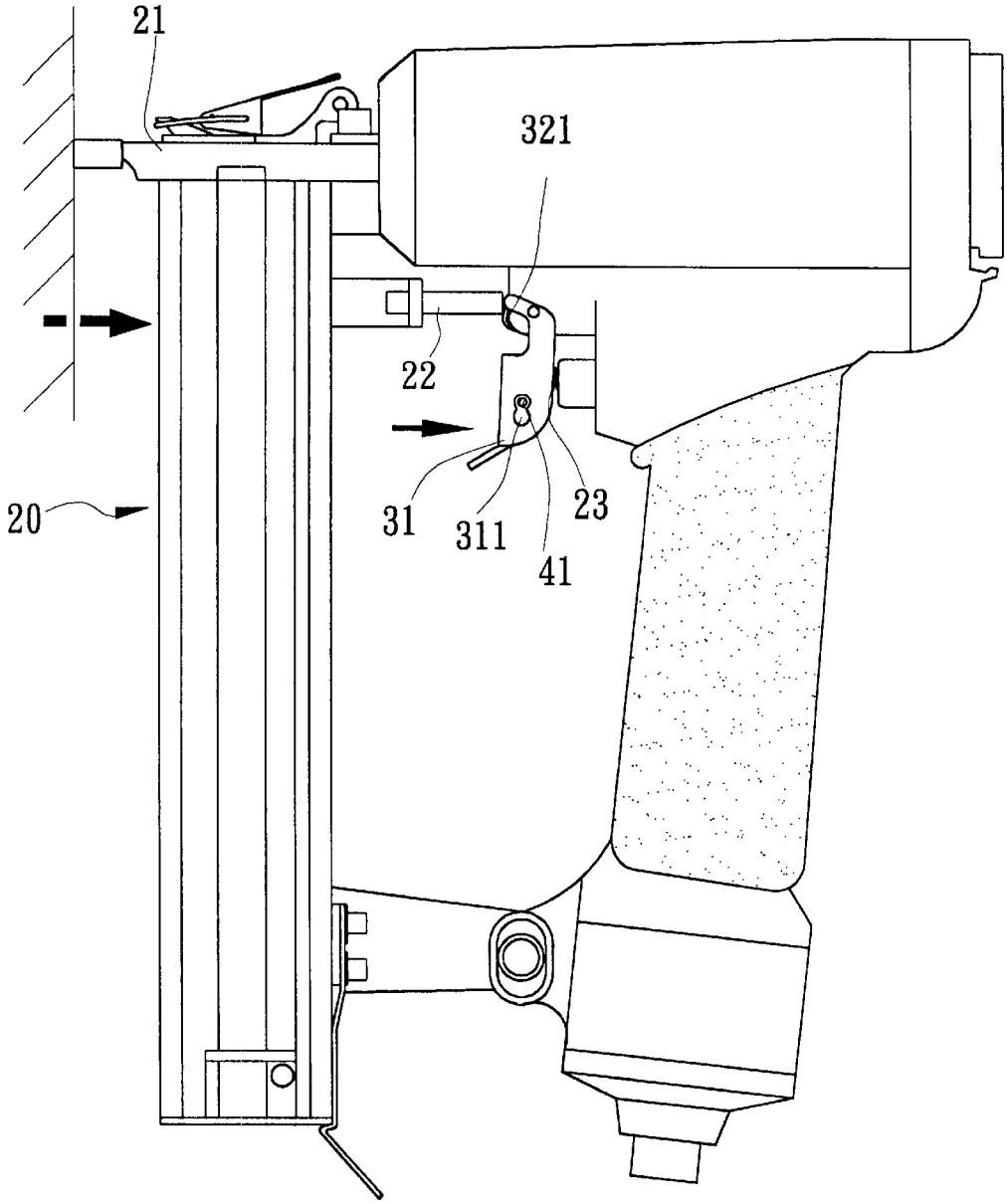
FIG. 6 is a side view of the present invention in a sequential discharge state.
Figure 7:
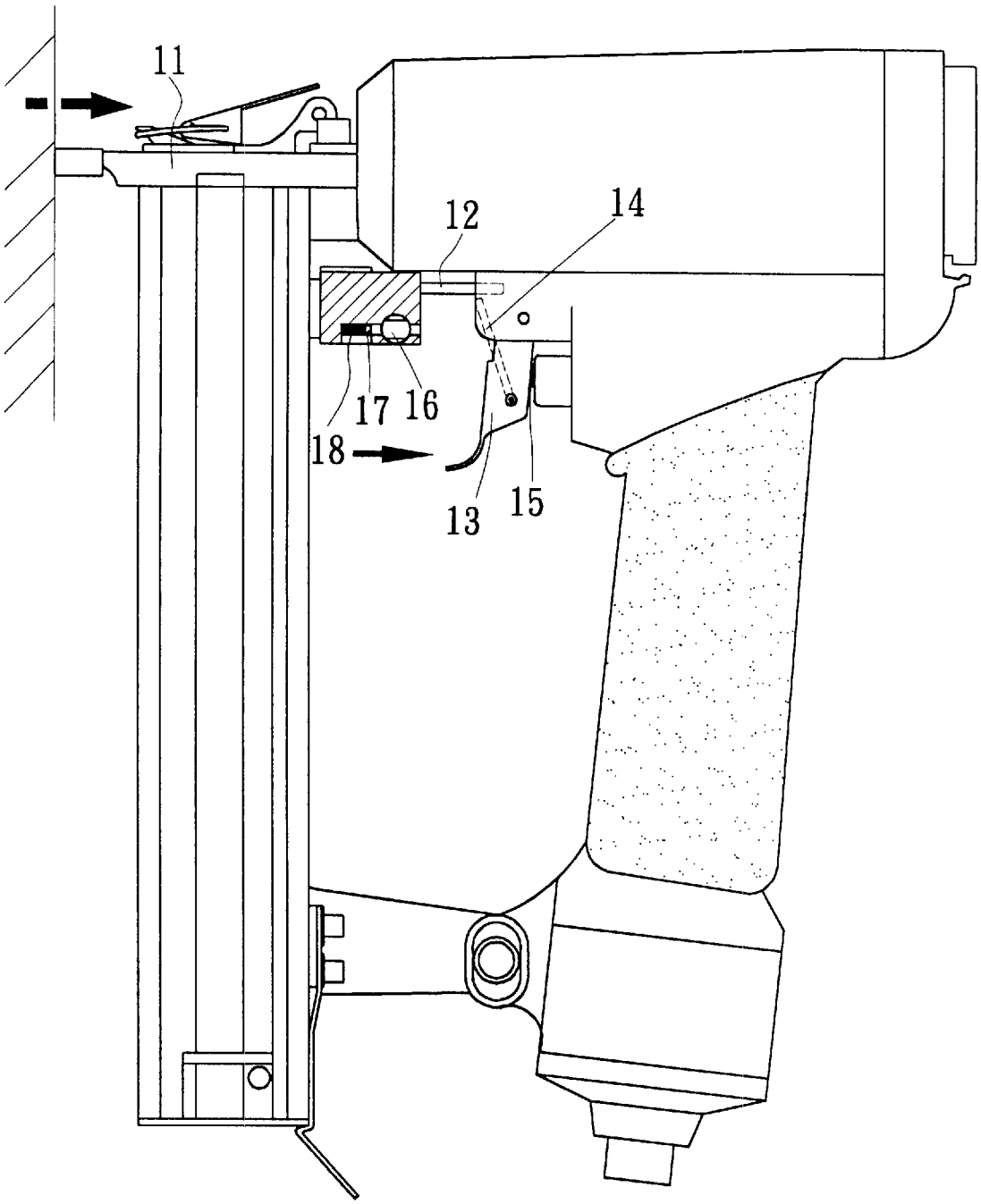
FIG. 7 is a side view of the prior art in a single discharge state.
Figure 8:
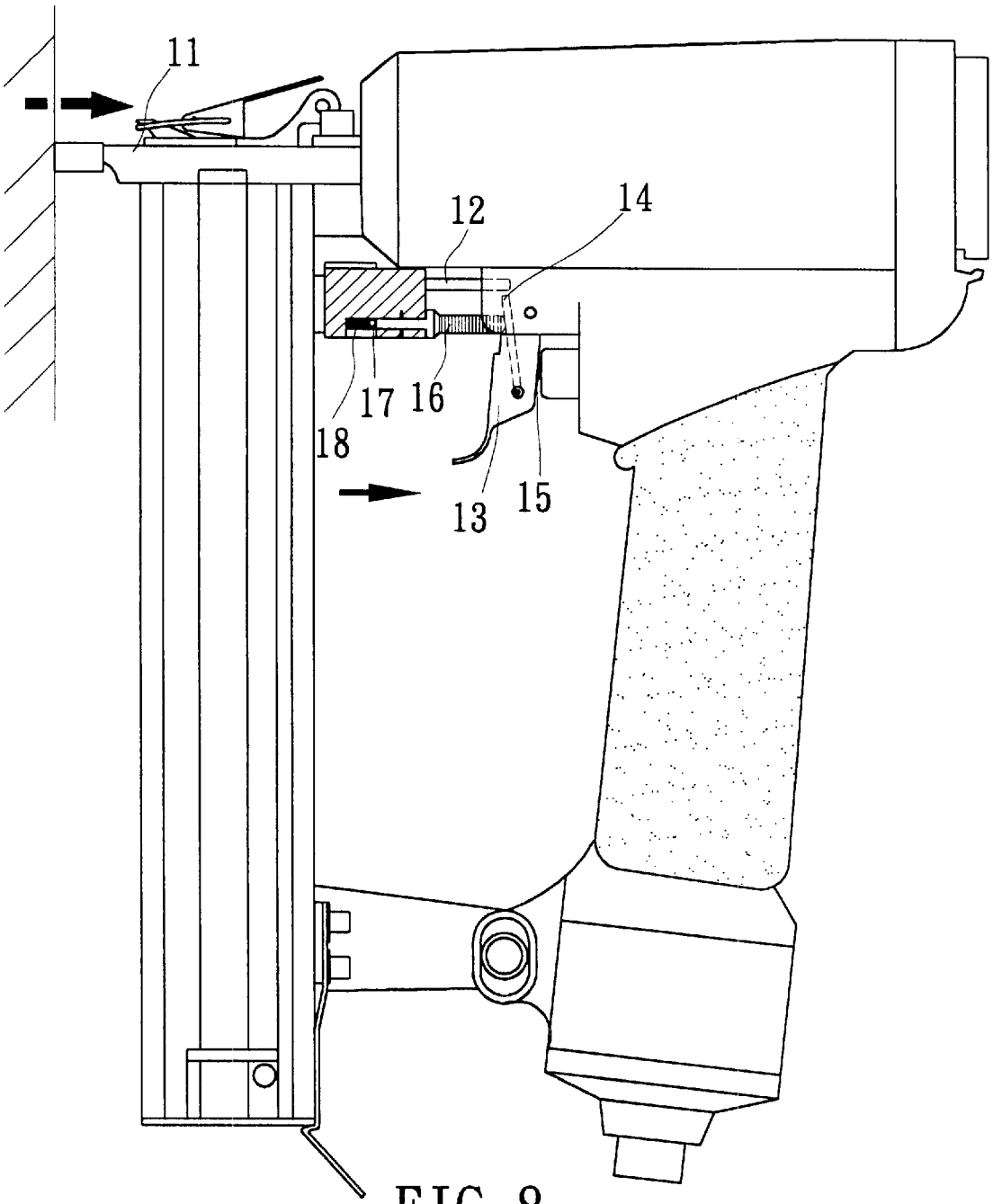
FIG. 8 is a side view of the prior art in a sequential discharge state.

Referring to the application embodiment of the present invention, the relative height between the secondary trigger 32 and the primary trigger 31 plays an important roll in the relative height between the secondary trigger 32 and the coupled rod 22. Therefore, when the adjusting assembly 40 is positioned in the first shaft holes 311 (as shown in FIG. 5), the secondary trigger 32 and the coupled rod 22 are in contact with each other in a single discharge state. When the adjusting assembly 40 is positioned in the second shaft holes 312 (as shown in FIG. 6), the secondary trigger 32 and the coupled rod 22 are in contact with each other in a sequential discharge state. Consequently, the adjusting assembly 40 of the present invention is easily shiftable and the assembly thereof can be rapidly completely. Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. An adjusting apparatus of a trigger of a pneumatic nailer comprising a gun body whose trigger assembly includes a primary trigger and a secondary trigger, said secondary trigger being pressed by a safety inflection arm, so as to be in contact with a firing key and in order for said gun body to create a firing effect, characterized in that at least two coupled shaft holes in connection are formed on respective side plates of said primary trigger while a neck is interposed between said two shaft holes, and that an adjusting assembly composed by a shaft, a compression spring and a press block is insertable into said shaft holes, and that said adjusting assembly and said secondary trigger are pivotably connected with each other, and that said adjusting assembly is movable between said two shaft holes so as to rapidly adjust the relative position between said secondary trigger and said safety inflection arm.

2. The adjusting apparatus of a trigger of a pneumatic nailer as claimed in claim 1, wherein two blocking members and two recessed members are interposed between one end of a shaft head and the opposite end thereof, and that said two blocking members are exactly receivable in said two shaft holes of said primary trigger while the outer diameter thereof is slightly larger than the width of said neck, and that the outer diameter of said two recessed members is slightly smaller than that of said two blocking members so that said recessed members are exactly passable through said necks, and that said press block is fixed at the other end of said shaft head while said compression spring is interposed between said primary trigger and said press block so that said blocking members are locked in either of said shaft holes in the ordinary state, and that said recessed members of said shaft pass through said necks in case of an external force on said press block so as to enter into another shaft hole.

* * * * *